US012295467B2

(12) United States Patent
Gakovic

(10) Patent No.: US 12,295,467 B2
(45) Date of Patent: May 13, 2025

(54) BELT-SECURED POUCH OR WALLET

(71) Applicant: Luka Gakovic, Victor, NY (US)

(72) Inventor: Luka Gakovic, Victor, NY (US)

( * ) Notice: Subject to any disclaimer, the term of this patent is extended or adjusted under 35 U.S.C. 154(b) by 108 days.

(21) Appl. No.: 17/943,332

(22) Filed: Sep. 13, 2022

(65) Prior Publication Data

US 2023/0284757 A1 Sep. 14, 2023

Related U.S. Application Data

(60) Provisional application No. 63/319,125, filed on Mar. 11, 2022.

(51) Int. Cl.
*A45C 1/04* (2006.01)

(52) U.S. Cl.
CPC ..... *A45C 1/04* (2013.01)

(58) Field of Classification Search
CPC ..... A45C 1/04
USPC ..... 224/222
See application file for complete search history.

(56) References Cited

U.S. PATENT DOCUMENTS

| | | | | |
|---|---|---|---|---|
| 2,383,748 | A * | 8/1945 | Sherman | A41F 9/002 224/663 |
| 4,068,787 | A * | 1/1978 | Craighead | A45C 1/04 224/163 |
| 4,174,793 | A | 11/1979 | Wisowaty | |
| 4,174,798 | A | 11/1979 | Pollard | |
| 5,082,157 | A * | 1/1992 | Emerson-Santos | A45C 1/04 224/587 |
| 5,611,470 | A * | 3/1997 | Vias | A45F 3/00 224/930 |
| 6,651,854 | B1 * | 11/2003 | LaCoste | A45F 5/021 224/236 |
| 9,320,345 | B2 * | 4/2016 | Newton | A45C 13/30 |
| D870,455 | S * | 12/2019 | Yang | D3/226 |
| 11,369,158 | B2 * | 6/2022 | Graves | A45F 5/021 |
| 11,517,061 | B2 * | 12/2022 | May | A45F 5/02 |
| 2003/0010801 | A1 * | 1/2003 | Schlipper | A45C 13/20 224/660 |
| 2003/0178459 | A1 * | 9/2003 | Aniwanou | A45C 1/04 224/665 |
| 2003/0189076 | A1 * | 10/2003 | Shapess | A45C 1/04 224/587 |
| 2004/0164115 | A1 | 8/2004 | Bristel | |
| 2006/0289590 | A1 | 12/2006 | Held | |

FOREIGN PATENT DOCUMENTS

| | | |
|---|---|---|
| CA | 1078797 | 8/2003 |
| CN | 2274440 | 2/1998 |
| EP | 1925226 | 11/2006 |
| FR | 2510879 | 8/1981 |
| FR | 2516364 | 11/1981 |
| FR | 2717351 | 3/1994 |
| FR | 2811522 | 7/2000 |
| GB | 2158346 | 11/1985 |
| WO | WO9616566 | 11/1995 |

* cited by examiner

*Primary Examiner* — Peter N Helvey
(74) *Attorney, Agent, or Firm* — Duane C. Basch

(57) ABSTRACT

A wallet or pouch designed to be worn on a belt, where at least one flap covering a pocket includes one or more apertures and is secured against opening by loops that pass through the apertures, and which are "locked" by the belt passing therethrough.

19 Claims, 4 Drawing Sheets

BELT-SECURED POUCH OR WALLET

This application claims priority under 35 U.S.C. § 119(e) from U.S. Provisional Patent Application No. 63/319,125 for a BELT-SECURED POUCH OR WALLET, filed Mar. 22, 2022 by L. Gakovic, which is hereby incorporated by reference in its entirety.

The disclosed embodiments are directed to improvements in or relating to pouches or wallets which may be carried or worn by a person, and in which items of value may be kept securely.

BACKGROUND AND SUMMARY

As fashion trends change, it is common for people to discard jackets in favor of more casual clothing, which has seen the disappearance of an 'inside pocket' in a jacket or blazer as a secure place for carrying valuable documents (e.g., passports), paper money, credit cards, smartphones, etc. Carrying such possessions in a side of back pocket of a pair of jeans or pants is far from secure as they may easily be 'picked' from such pockets or actually fall out during normal wear and movement. Additionally, it can be uncomfortable to have a substantial or rigid item such as a passport or smartphone in one's pocket.

Special belts with means for carrying items such as money are known but these provide little more than a small internal or external pocket, one wall of which is formed by the belt itself. The larger the pouch, the more ungainly and uncomfortable it is to wear; the smaller the pouch, the less useful for storing items. These problems may be eased somewhat if the pouch is not firmly secured to the user, but then the risk of loss through accident or theft is increased.

It is an object of the disclosed embodiments to provide a pouch or wallet that may be of a suitable size yet flexible and capable of being securely affixed to a person without being uncomfortable to wear.

Disclosed in embodiments herein is a belt-secured pouch or wallet comprising: an outer pouch having at least one pocket-portion for receiving items therein; the pocket portion including a back surface that extends above the pocket-portion as a flap that approximates the width of the pocket-portion and is suitable for folding over the pocket-portion to conceal items in the pocket portion; the pocket portion having a front surface, the front surface having at least one loop that extend outward from the front surface; and wherein the flap further includes an aperture corresponding to the size and position of the at least one loop when the flap is folded over the pocket-portion, and the flap extends along and parallel to the outer face of the front surface such that the at least one loop extends through the aperture to allow a belt to pass through the loops while the flap is closed over the front surface and thereby securely prevent the flap, and the pocket portion, from being opened or accessed as long as the belt remains in place.

Also disclosed in embodiments herein is a belt-secured pouch or wallet comprising: an outer pouch made of a flexible material and having at least one pocket-portion for receiving items therein; the pocket portion including a back surface that extends above the pocket-portion as a flap that approximates the width of the pocket-portion and is suitable for folding over the pocket-portion to cover and securely conceal items therein; the pocket portion having a front surface, the front surface having a plurality of parallel loops that extend outward from the front surface; and wherein the flap further includes a plurality of apertures corresponding to the size and position of the plurality of loops when the flap is folded over the pocket-portion, and the flap extends along and parallel to the outer face of the front surface such that the plurality of loops extend through the apertures to allow a belt to pass through the plurality of loops while the flap is closed over the front surface and thereby securely prevent the flap, and the pocket portion, from being opened or accessed as long as the belt remains in place.

Figure 1:
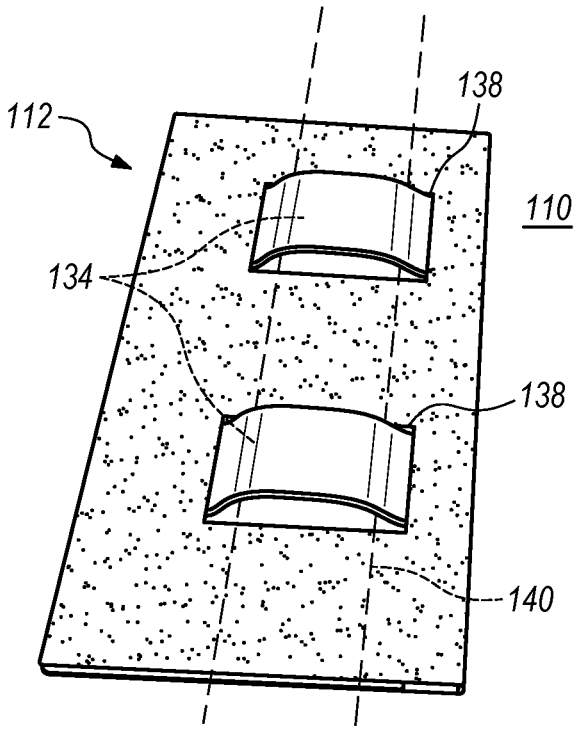
FIGS. 1 and 2 are illustrative perspective views of a front side of an embodiment of the belt-secured pouch or wallet that includes interior pocket dividers.

The various embodiments described herein are not intended to limit the disclosure to those embodiments described. On the contrary, the intent is to cover all alternatives, modifications, and equivalents as may be included within the spirit and scope of the various embodiments and equivalents set forth. For a general understanding, reference is made to the drawings. In the drawings, like references have been used throughout to designate identical or similar elements. It is also noted that the drawings may not have been drawn to scale and that certain regions may have been purposely drawn disproportionately so that the features and aspects could be properly depicted.

DETAILED DESCRIPTION

Figure 2:
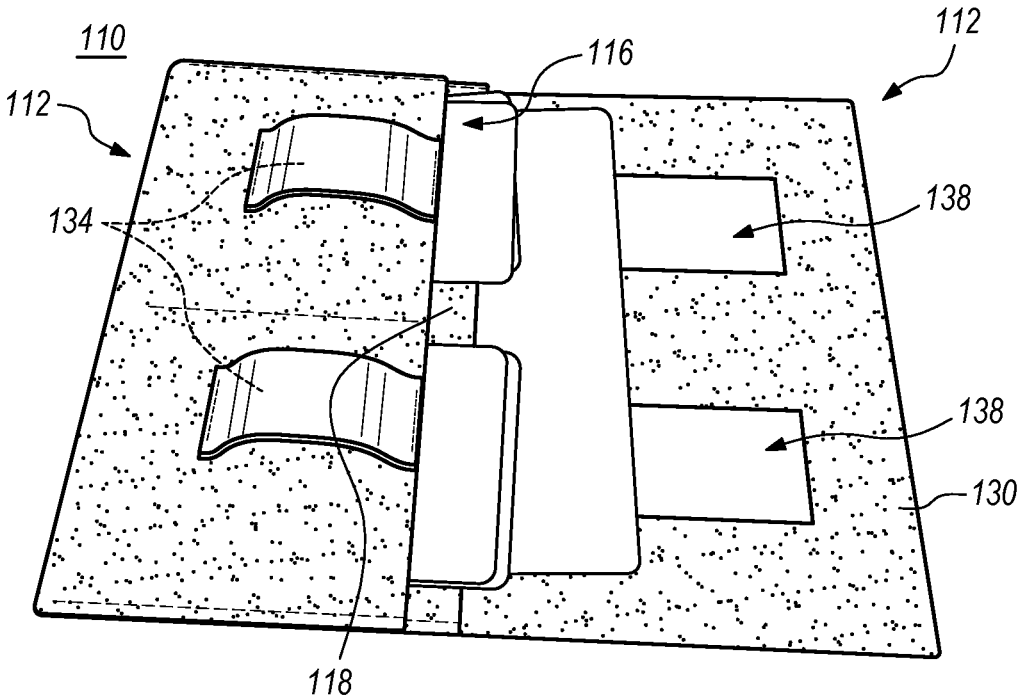

Referring initially to FIGS. 1 and 2, illustrated therein are perspective views of one embodiment of a belt-secured pouch or wallet 110. The front side 112 of the belt-secured pouch or wallet may, in combination with the back side 114, define a pocket 116. And pocket 116 may further include one or more dividers 118.

Figure 3:
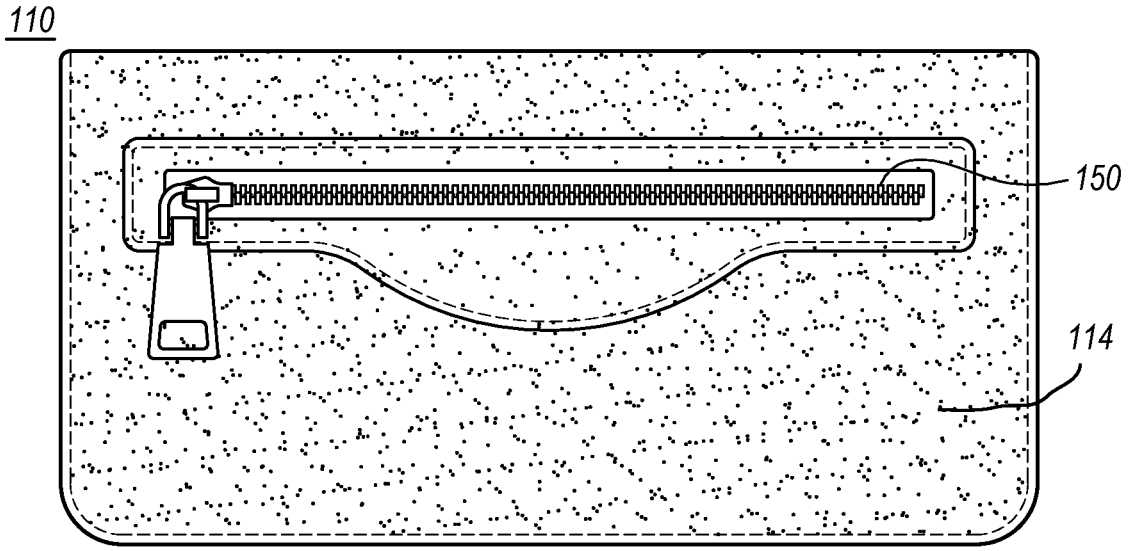
FIG. 3 is an exemplary view of a back side of one embodiment of the belt-secured pouch or wallet that includes a zippered outer pocket on the back.

Also considering FIG. 3 there is shown an exemplary view of back side 114 of an alternative embodiment of the belt-secured pouch or wallet 110 that includes a zippered outer pocket 130 on the back side 114. As will be appreciated by the illustrations of FIGS. 1-3, for example, the belt-secured pouch or wallet comprises an outer pouch or pocket 116 made of a flexible material such as leather or a man-made fabric. As illustrated in FIG. 2, at least one pocket-portion 116 is suitable for receiving items (e.g., documents, money and valuables, keys, etc.) therein.

Figure 4A:
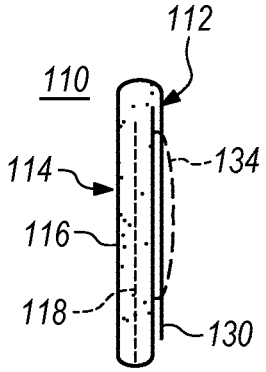
FIGS. 4A-4B are respective side, front and back illustrations of the embodiment of FIGS. 1-2.
Figure 4B:
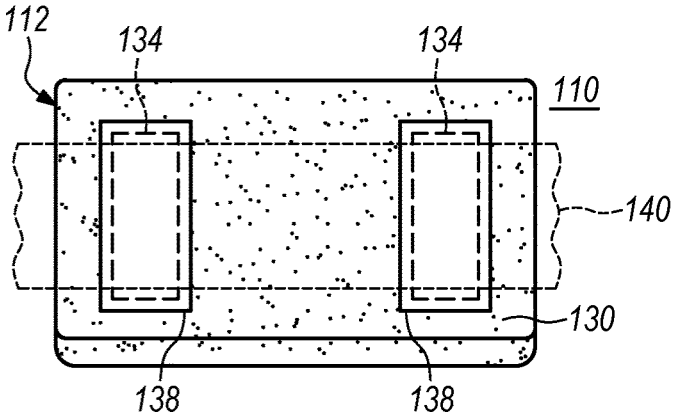

The pocket portion includes a back surface that extends above the pocket-portion 116 as a flap 130 that approximates the width of the pocket-portion 116 and is suitable for folding over the pocket-portion to conceal the items therein as illustrated in FIGS. 1 and 4A-4B. The pocket portion 116, as illustrated in FIG. 4A, has a front surface 112, and the front surface has a loop (e.g., one, two or more parallel loops) 134 that extend outward from the front surface 112. The flap 130 further includes an aperture(s) 138 corresponding to the size and position of the parallel loop(s) 134, so that when the flap is folded over the pocket-portion 116 the flap extends along and parallel to the outer face of the front surface 112 such that the loop(s) 134 extends through the aperture(s) 138 in a manner suitable to allow a belt 140 to pass through the loops 138 while the flap 130 is closed over the front surface and thereby securely prevent the flap 130, the pocket portion 116 and items placed therein, from being opened or accessed as long as the belt 140 remains in place though the loop(s) 134.

Figure 5A:
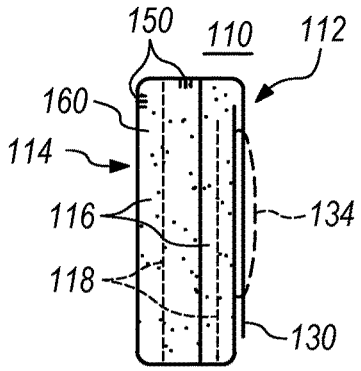
FIGS. 5A-5C are respective side and back illustrations of an embodiment of the belt-secured pouch or wallet with a zippered outer pocket as in FIG. 3.
Figure 5B:
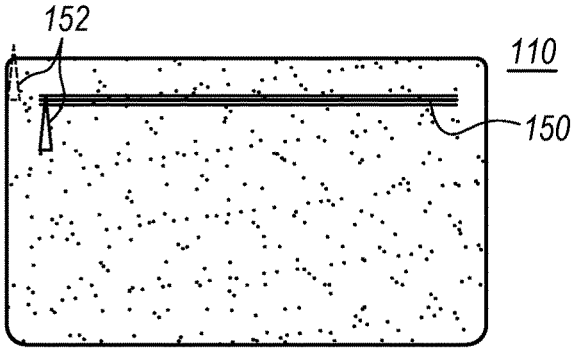
Figure 5C:
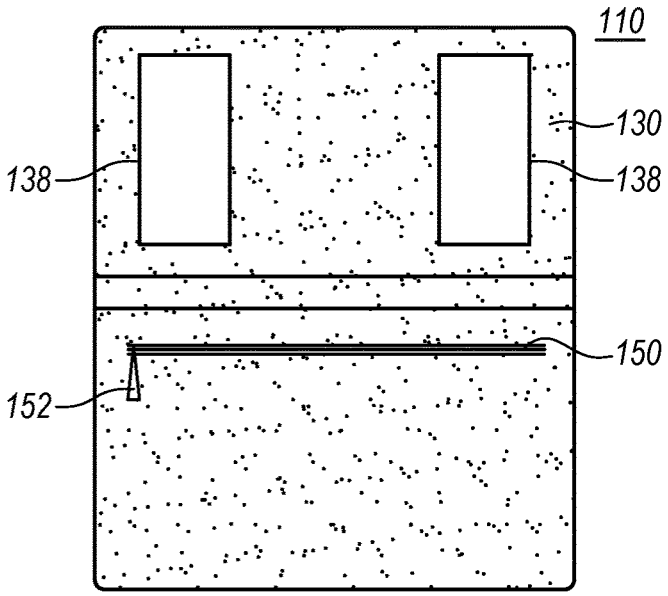

Referring to FIGS. 3, 5B and 5C, the belt-secured pouch 110 may also have a back surface 114 of the pocket portion 116 that includes a zipper 150, with a zipper pull 152, that may be placed along the back side 114 or top to provide access to at least a portion of the pouch 110. As will be appreciated from FIGS. 5A-5C, the belt-secured pouch 110 may further include a separate, additional pocket 160 attached to the back side 114 of the pocket portion 116. The separate pocket 160 also a zipper(s) 150 providing access to the separate pocket without compromising access to the pocket-portion while the flap remains closed.

Figure 6A:
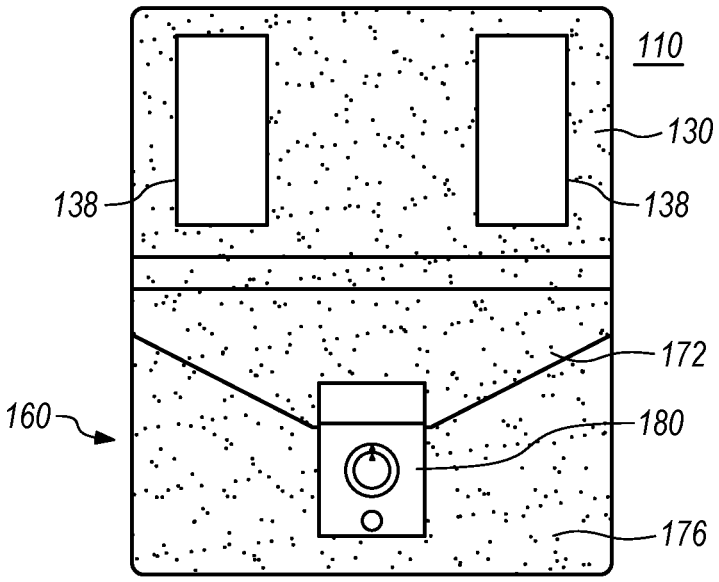
FIGS. 6A-6C are respective side, front and back illustrations of an embodiment of the belt-secured pouch or wallet with an outer pocket, on the back, that has a flap with a dial/clock-type combination lock.
Figure 6B:
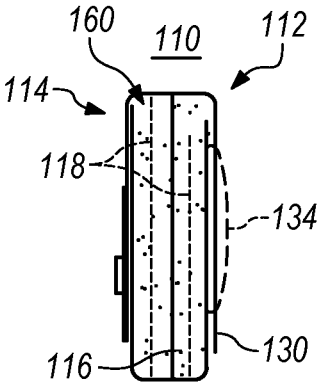
Figure 6C:
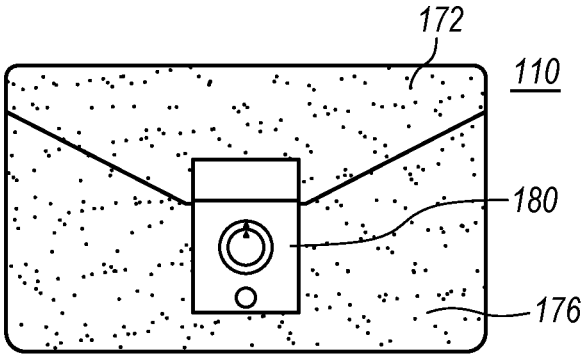

In the embodiment of FIGS. 6A-6C, there is illustrated yet another alternative embodiment of belt-secured pouch or wallet 110, also having a separate outer pocket 160 attached to the back side 114 of the pocket portion 116. In this embodiment of the pouch 110, access to the outer pocket 160 is controlled by a locking mechanism 180. While a variety of locking mechanisms may be employed, in one embodiment the pocket is secured by a flap 172 that covers the top of pocket 160, and clasps in some manner to the face 176 of the outer pocket. The locking mechanism 180 may be selected from a group of mechanisms such as a keyed lock, a combination lock, dial lock (e.g., turn/twist lock), ring and hasp lock, lockable zipper pulls, padlocks, tuck locks, briefcase combo lock (e.g., Crest Lock Co.), clock-type combination lock (e.g., #CH1W-M.M.C. di Colombo A. & C. S.n.c.). It is also contemplated that the locking mechanism 180 may include combinations of one or more of the listed devices.

As will be appreciated, the disclosed embodiments for the wallet or pouch may be made in different sizes and relative dimensions, and while the shape of the illustrated embodiments is generally rectangular, other shapes (e.g., rounded corners, oval or elliptical, circular, etc.) may be used for one or more components of the secure pouch.

It should be understood that various changes and modifications to the embodiments described herein will be apparent to those skilled in the art. Such changes and modifications can be made without departing from the spirit and scope of the present disclosure and without diminishing its intended advantages. It is therefore anticipated that all such changes and modifications be covered by the instant application.

What is claimed is:

1. A belt-secured pouch or wallet comprising:

an outer pouch having at least one pocket-portion for receiving items therein;

the pocket portion including a back surface that extends above the pocket-portion as a flap that approximates the width of the pocket-portion and is suitable for folding over the pocket-portion to conceal items in the pocket portion;

the pocket portion having a front surface, the front surface having at least one loop that extends outward from the front surface; and wherein the flap further includes an aperture corresponding to the size and position of the at least one loop when the flap is folded over the pocket-portion, and the flap extends along and parallel to the outer face of the front surface such that the at least one loop extends through the aperture to allow a belt to pass through the at least one loop while the flap is closed over the front surface and thereby securely prevent the flap, and the pocket portion, from being opened or accessed as long as the belt remains in place.

2. The belt-secured pouch according to claim 1, wherein the back surface of the pocket portion includes a zipper providing access to at least a portion of the pouch.

3. The belt-secured pouch according to claim 1, further including a separate pocket attached to the back of the pocket portion, the separate pocket includes a zipper providing access to the separate pocket without compromising access to the pocket-portion while the flap remains closed.

4. The belt-secured pouch according to claim 1, further including a separate outer pocket attached to the back of the pocket portion, wherein access to the outer pocket is controlled by a locking mechanism.

5. The belt-secured pouch according to claim 4, wherein said locking mechanism is selected from the group consisting of: a keyed lock, a combination lock, dial lock, turn/twist lock, ring and hasp lock, lockable zipper pulls, padlocks, tuck locks, briefcase combo lock, clock-type combination lock, and combinations thereof.

6. The belt-secured pouch according to claim 1, wherein at least said outer pouch comprises a flexible material.

7. A belt-secured pouch or wallet comprising:

an outer pouch made of a flexible material and having at least one pocket-portion for receiving items therein;

the pocket portion including a back surface that extends above the pocket-portion as a flap that approximates the width of the pocket-portion and is suitable for folding over the pocket-portion to cover and securely conceal items therein;

the pocket portion having a front surface, the front surface having a plurality of parallel loops that extend outward from the front surface; and the flap further includes an aperture corresponding to the size and position of the at least one loop when the flap is folded over the pocket-portion, and the flap extends along and parallel to the outer face of the front surface such that the at least one loop extends through the aperture to allow a belt to pass through the at least one loop while the flap is closed over the front surface and thereby securely prevent the flap, and the pocket portion, from being opened or accessed as long as the belt remains in place.

8. The belt-secured pouch according to claim 7, wherein the back surface of the pocket portion includes a zipper providing access to at least a portion of the pouch.

9. The belt-secured pouch according to claim 1, further including a separate pocket attached to the back of the pocket portion, the separate pocket includes a zipper providing access to the separate pocket without compromising access to the pocket-portion while the flap remains closed.

10. The belt-secured pouch according to claim 7, further including a separate outer pocket attached to the back of the pocket portion, wherein access to the outer pocket is controlled by a locking mechanism.

11. The belt-secured pouch according to claim 10, wherein said locking mechanism is selected from the group consisting of: a keyed lock, a combination lock, dial lock, turn/twist lock, ring and hasp lock, lockable zipper pulls, padlocks, tuck locks, briefcase combo lock, clock-type combination lock, and combinations thereof.

12. The belt-secured pouch according to claim 7 wherein at least said outer pouch comprises a flexible material.

13. A belt-secured pouch or wallet comprising:

an outer pouch having at least one pocket-portion for receiving items therein, the pocket portion having a front surface and the front surface having at least one loop through which a belt can pass; and the pocket portion further including a back surface that extends above the pocket-portion as a flap that approximates the width of the pocket-portion and is suitable for folding over the pocket-portion to conceal items in the pocket portion;

wherein the flap further includes at least one aperture corresponding to the size and position of the at least one loop when the flap is folded over the front surface of the pocket-portion, such that a belt can pass through the at least one loop and the at least one aperture while the flap is closed over the front surface and thereby securely prevent the flap, and the pocket portion, from being opened or accessed as long as the belt remains in place.

14. The belt-secured pouch according to claim 13, wherein the back surface of the pocket portion includes a zipper providing access to at least a portion of the pouch.

15. The belt-secured pouch according to claim 13, further including a separate pocket attached to the back of the pocket portion, the separate pocket includes a zipper providing access to the separate pocket without compromising access to the pocket-portion while the flap remains closed.

16. The belt-secured pouch according to claim 13, further including a separate outer pocket attached to the back of the pocket portion, wherein access to the outer pocket is controlled by a locking mechanism.

17. The belt-secured pouch according to claim 16, wherein said locking mechanism is selected from the group consisting of: a keyed lock, a combination lock, dial lock, turn/twist lock, ring and hasp lock, lockable zipper pulls, padlocks, tuck locks, briefcase combo lock, clock-type combination lock, and combinations thereof.

18. The belt-secured pouch according to claim 13, wherein at least said outer pouch comprises a flexible material.

19. The belt-secured pouch according to claim 13, wherein the pocket portion has a pair of parallel loops through which the belt can pass and the flap further includes a pair of apertures corresponding to the size and position of the pair of parallel loops.

* * * * *